US011725652B2

(12) United States Patent
Yin et al.

(10) Patent No.: US 11,725,652 B2
(45) Date of Patent: Aug. 15, 2023

(54) ELECTRIC OIL PUMP

(71) Applicant: ZHEJIANG SANHUA INTELLIGENT CONTROLS CO., LTD, Zhejiang (CN)

(72) Inventors: Bingjiu Yin, Zhejiang (CN); Wei Ye, Zhejiang (CN); Yongfeng Sun, Zhejiang (CN); Kai Zhang, Zhejiang (CN); Zhiwang Wu, Zhejiang (CN); Fangxu Qian, Zhejiang (CN)

(73) Assignee: ZHEJIANG SANHUA INTELLIGENT CONTROLS CO., LTD, Zhejiang (CN)

( * ) Notice: Subject to any disclaimer, the term of this patent is extended or adjusted under 35 U.S.C. 154(b) by 293 days.

(21) Appl. No.: 17/050,195

(22) PCT Filed: May 27, 2019

(86) PCT No.: PCT/CN2019/088618
§ 371 (c)(1),
(2) Date: Oct. 23, 2020

(87) PCT Pub. No.: WO2019/228312
PCT Pub. Date: Dec. 5, 2019

(65) Prior Publication Data

US 2021/0239115 A1 Aug. 5, 2021

(30) Foreign Application Priority Data

May 28, 2018 (CN) ..... 201810519273.5

(51) Int. Cl.
*F04C 11/00* (2006.01)
*F04C 2/10* (2006.01)

(52) U.S. Cl.
CPC ..... *F04C 11/008* (2013.01); *F04C 2/10* (2013.01); *F04C 2240/10* (2013.01);
(Continued)

(58) Field of Classification Search
CPC ..... F04B 35/04; F04B 49/06; F04B 39/00; F04C 2/10; F04C 2240/20; F04C 2240/30;
(Continued)

(56) References Cited

U.S. PATENT DOCUMENTS 4,964,788 A * 10/1990 Itameri-Kinter ..... H01R 13/74 439/926
8,896,169 B2 * 11/2014 Song ..... H02K 5/207 310/71
(Continued)

FOREIGN PATENT DOCUMENTS

CN 201636022 U 11/2010
CN 103590941 A 2/2014
(Continued)

OTHER PUBLICATIONS

English Translation of CN-204290629-U (Year: 2014).*
(Continued)

*Primary Examiner* — Connor J Tremarche
(74) *Attorney, Agent, or Firm* — Crain Caton & James; William P. Jensen

(57) ABSTRACT

An electric oil pump includes a pump housing provided with an a first cavity and a second cavity; a first rotor assembly disposed in the first cavity; a stator assembly and a second rotor assembly that are disposed in the second cavity; an electric control board assembly; an isolating member, where the stator assembly is disposed at a first side of the isolating member, the electric control board assembly is disposed at a second side of the isolating member; and a wiring terminal fixedly connected to the isolating member; where a connecting position between the wiring terminal and the isolating member is sealed and a connecting position between the isolating member and the pump housing is sealed. The
(Continued)

electric oil pump can prevent working medium from affecting the performance of the electric control board assembly.

17 Claims, 12 Drawing Sheets

(52) U.S. Cl.
CPC ..... *F04C 2240/20* (2013.01); *F04C 2240/30* (2013.01); *F04C 2240/60* (2013.01)

(58) Field of Classification Search
CPC ..... F04C 2240/10; F04C 2240/60; F04C 11/008; H02K 11/30
See application file for complete search history.

(56) References Cited

U.S. PATENT DOCUMENTS

| | | | | |
|---|---|---|---|---|
| 2004/0027014 | A1* | 2/2004 | Weigold | H02K 11/33 310/68 R |
| 2004/0062664 | A1* | 4/2004 | Weigold | F04D 13/064 417/357 |
| 2014/0099217 | A1 | 4/2014 | McCormick et al. | |
| 2014/0241903 | A1 | 8/2014 | Honda | |
| 2015/0159656 | A1* | 6/2015 | Urabe | H02K 1/02 165/104.31 |
| 2016/0123194 | A1* | 5/2016 | Kajiura | F01L 1/352 123/90.15 |
| 2016/0268875 | A1 | 9/2016 | Roos et al. | |

FOREIGN PATENT DOCUMENTS

| | | | | |
|---|---|---|---|---|
| CN | 204290629 | U | | 4/2015 |
| CN | 204290629 | U | * | 4/2015 |
| CN | 207363874 | U | | 5/2015 |
| CN | 205509792 | U | | 8/2016 |
| CN | 207363374 | | | 5/2018 |
| CN | 207363873 | U | | 5/2018 |
| CN | 207363874 | U | | 5/2018 |
| CN | 208571776 | U | | 3/2019 |
| DE | 3822897 | A1 | | 1/1990 |
| DE | 102012210197 | A1 | | 5/2013 |
| EP | 1635069 | A1 | | 3/2006 |
| EP | 2497952 | A2 | | 3/2012 |
| EP | 2497952 | A3 | | 3/2012 |
| EP | 2570672 | A2 | | 9/2012 |
| EP | 2570672 | A3 | | 9/2012 |
| JP | S5688982 | A | | 7/1981 |
| JP | 08210280 | A | | 8/1993 |
| JP | 2013100755 | A | | 5/2013 |
| WO | 0235098 | A1 | | 5/2002 |
| WO | 2015067810 | A1 | | 5/2015 |

OTHER PUBLICATIONS

Korean Intellectual Property Office, Notification of Reason for Refusal, Application No. 10-2020-7032855, dated Nov. 29, 2021, 5 pages, Korean Intellectual Property Office, Korea.

Andrea Durante, Communication—Extended European Search Report, Application No. 19811524.8, dated Nov. 12, 2021, 7 pages, European Patent Office, Munich Germany.

Kotoku Yamazaki, Notice of Reasons for Refusal, Application No. 2020-563645, dated Aug. 5, 2021, 7 pages, Japanese Patent Office, Japan.

Zhang Min, International Search Report for PCT App. No. PCT/CN2019/088618, dated Aug. 16, 2019, 4 pages, China National Intellectual Property Administration, China.

Search Report for CN App. No. 201810519273.5, 1 page, China National Intellectual Property Administration, China.

Bao Ya, First Office Action for CN App. No. 201810519273.5, dated Apr. 13, 2020, 10 pages, China National Intellectual Property Administration, China.

Hiraki Kakizaki, Notice of Reasons for Refusal, Japanese Patent Application No. 2020-563645, dated Jan. 13, 2023, 17 pages, Japanese Patent Office.

* cited by examiner

ELECTRIC OIL PUMP

This application is a U.S. National Stage Application of PCT Application Serial No. PCT/CN19/88618, filed on May 27, 2019, which claims priority to Chinese patent application No. 201810519273.5 filed on May 28, 2018, both of which are incorporated herein by reference in their entirety.

TECHNICAL FIELD

The present disclosure relates to a field of vehicles, for example, an electric oil pump.

BACKGROUND

The vehicle industry is developing rapidly towards vehicle performances being safer, more reliable, more stable, fully automatic intelligentizatied, environmental protective and energy saving, an electric oil pump is widely used in at least one of a lubrication system and a cooling system of a vehicle, and can well meeting requirements of a market.

The electric oil pump mainly serves as a power source for at least one of the lubrication system and the cooling system of the vehicle, for example, at least one of a lubrication system and a cooling system of a car. Generally, the electric oil pump includes an electric control board assembly, and how to prevent a working medium from affecting performance of the electric control board assembly is a technical problem that needs to be considered in a design process of the electric oil pump.

SUMMARY

The present disclosure provides an electric oil pump, capable of preventing a working medium from affecting performance of an electric control board.

An electric oil pump includes a pump housing provided with an inner pump cavity, where the inner pump cavity includes a first cavity and a second cavity that are in communication with each other; a first rotor assembly disposed in the first cavity; a stator assembly and a second rotor assembly that are disposed in the second cavity; a pump shaft, where the first rotor assembly is disposed adjacent to a first end of the pump shaft, and the second rotor assembly is disposed adjacent to a second end of the pump shaft; an electric control board assembly; an isolating member, where the stator assembly is disposed at a first side of the isolating member, the electric control board assembly is disposed at a second side of the isolating member, and the isolating member is connected to the pump housing; and a wiring terminal fixedly connected to the isolating member; where a connecting position between the wiring terminal and the isolating member is sealed and a connecting position between the isolating member and the pump housing is sealed, so that the second cavity is unable to communicate with one side of the isolating member where the electric control board assembly is located via the connecting position between the wiring terminal and the isolating member, and via the connecting position between the isolating member and the pump housing.

Since the first cavity and the second cavity of the electric oil pump are in communication with each other, part of the working medium in the first cavity may enter the second cavity and contact with at least part of the stator assembly, and such arrangement is beneficial to heat dissipation of the stator assembly. The electric oil pump includes the isolating member. The stator assembly is disposed on the first side of the isolating member, the electric control board is disposed on the second side of the isolating member, and the isolating member is fixedly connected to the wiring terminal. The connecting position between the wiring terminal and the isolating member is sealed, the connecting position between the isolating member and the pump housing is sealed, the second cavity is not in communication with the one side of the isolating member where the electric control board assembly is located, and the working medium in the second cavity cannot enter the one side of the isolating member where the electric control board is located through the connecting position between the wiring terminal and the isolating member or the connecting position between the isolating member and the pump housing. Such arrangements are beneficial to prevent the working medium from affecting the performance of the electric control board, thereby avoiding affecting performance of the electric oil pump.

DETAILED DESCRIPTION

An electric oil pump in the present embodiment is able to provide flowing power for a working medium of at least one of a lubrication system and a cooling system of a vehicle.

The electric oil pump in the present embodiment can mainly provide the flowing power for the working medium of the lubrication system and/or the cooling system of the vehicle, specifically, a lubrication system and/or a cooling system of a vehicle transmission system.

Figure 1:
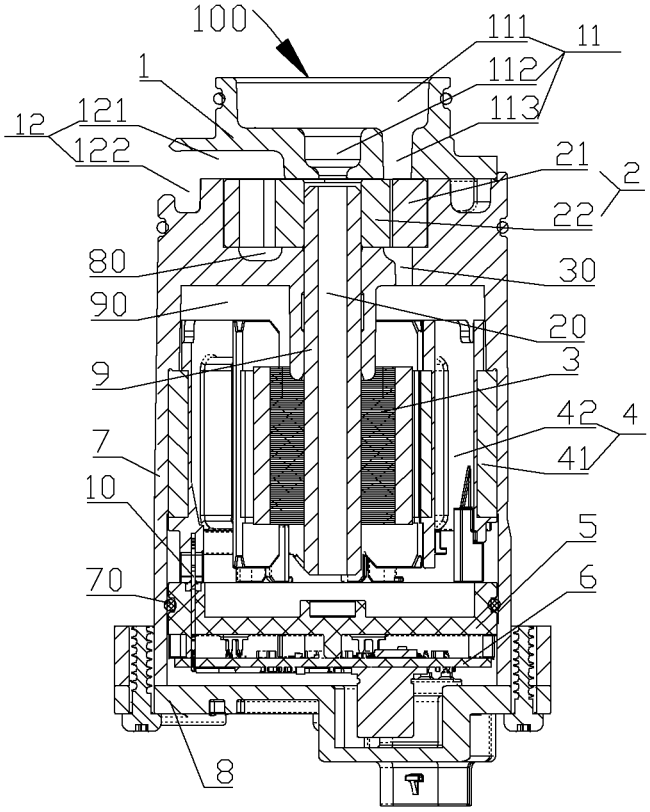
FIG. 1 is a cross-sectional structural schematic view illustrating an electric oil pump in the first implementation manner according to an embodiment.

Referring to FIG. 1, the electric oil pump 100 includes a pump housing, a first rotor assembly 2, a stator assembly 4, a second rotor assembly 3 and an electric control board assembly 6. The pump housing is provided with an inner pump cavity, and the first rotor assembly 2, the stator assembly 4, the second rotor assembly 3 and the electric control board assembly 6 are disposed in the pump inner cavity. In the present embodiment, the inner pump cavity includes a first cavity 80 and a second cavity 90, where the first rotor assembly 2 is disposed in the first cavity 80, and the stator assembly 4 and the second rotor assembly 3 are disposed in the second cavity 90. The stator assembly 4 is sleeved onto an outer periphery of the second rotor assembly 3, the first rotor assembly 2 is disposed adjacent to a first end of a pump shaft 9, and the second rotor assembly 3 is disposed adjacent to a second end of the pump shaft 9. The first rotor assembly 2, the second rotor assembly 3, the isolating member 5, and the electric control board assembly 6 are distributed along an axial direction of the electric oil pump, and the second rotor assembly 3 is disposed between the first rotor assembly 2 and the electric control board assembly 6.

Referring to FIG. 1, the stator assembly 4 includes a stator iron core 41 and a coil 42. When the electric oil pump 100 is in operation, the electric control board assembly 6 controls current passing through the coil 42 of the stator assembly 4 to vary according to a predetermined rule, so as to control the stator assembly 4 to generate a variable excitation magnetic field; the second rotor assembly 3 rotates under action of the excitation magnetic field, and may directly or indirectly drive part of components of the first rotor assembly 2 to rotate. When the first rotor assembly 2 rotates, a volume of a hydraulic cavity in the first rotor assembly 2 varies, so that the working medium is pressed out to a fluid outlet to generate flowing power.

Referring to FIG. 1, in the present embodiment, the pump housing includes a first housing 8, a second housing 7 and a third housing 1, where the first housing 8 is relatively fixedly connected to the second housing 7 and the third housing 1, respectively. In the present embodiment, the third housing 1 and the second housing 7 are connected by a screw or a bolt. Such arrangement enables it easier to disassemble and assemble the electric oil pump, thereby facilitating maintenance of the first rotor assembly 2 of the electric oil pump. In an embodiment, the third housing 1 and the second housing 7 may also be connected in other manners, such as in a plug-in manner, in a clamping manner, etc., and the second housing 7 is fixedly connected to the first housing 8. In an embodiment, the second housing 7 and the first housing 8 are connected by a screw or a bolt. Such arrangement enables it easier to disassemble and assemble the electric oil pump and enables connection between the second housing 7 and the first housing 8 more reliable. In the present embodiment, the electric control board assembly 6 is disposed in an empty cavity between the second housing 7 and the first housing 8. Such arrangement also facilitates maintenance of the electric control board assembly 6 in the electric oil pump. In an embodiment, the second housing 7 and the first housing 8 may also be connected in other manners, such as in a plug-in manner, in a clamping manner.

Figure 2:
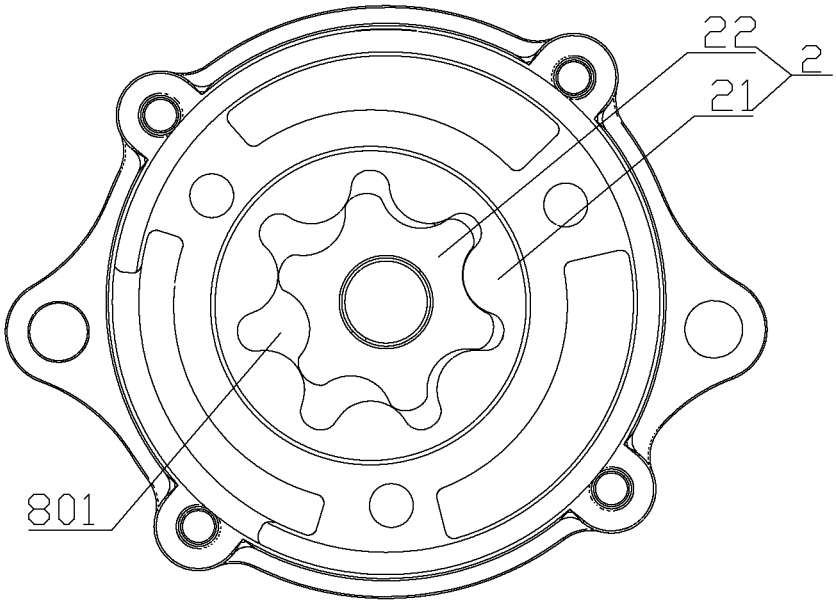
FIG. 2 is a front view illustrating the electric oil pump in FIG. 1 without a pump cover.

Referring to FIG. 2, the first rotor assembly 2 includes a first rotor 21 and a second rotor 22, where the first rotor 21 includes a plurality of internal teeth, and the second rotor 22 includes a plurality of external teeth. A hydraulic cavity 801 is formed between the internal teeth of the first rotor 21 and the external teeth of the second rotor 22. In the present embodiment, the hydraulic cavity 801 is also part of the first cavity 80. In the present embodiment, the first rotor 21 is sleeved onto an outer periphery of the second rotor 22. Referring to FIG. 1, the electric oil pump further includes a fluid inlet 11 and a fluid outlet 12, the working medium may enter the hydraulic cavity 801 through the fluid inlet 11, and may exit the hydraulic cavity 801 through the fluid outlet 12. Because a certain eccentricity exists between the first rotor 21 and the second rotor 22, when the second rotor 22 rotates, part of the external teeth of the second rotor 22 are meshed with part of the internal teeth of the first rotor 21, thereby driving the first rotor 21 to rotate. During rotating the first rotor 21 and the second rotor 22 for one revolution, the volume of the hydraulic cavity 801 changes. When the first rotor assembly 2 rotates from a starting position to a certain angle, the volume of the hydraulic cavity 801 gradually increases to form a local vacuum, and the working medium is sucked into the hydraulic cavity 801 from the fluid inlet 11. When the first rotor 21 and the second rotor 22 continue to rotate, the volume of the hydraulic cavity 801 filled with the working medium decreases gradually, and the working medium is squeezed, so that the working medium entering the hydraulic cavity 801 is pressed out to the fluid outlet 12 to generate the flowing power. In the present embodiment, the electric oil pump 100 further includes the pump shaft 9, and the pump shaft 9 may drive part of the first rotor assembly 2 to rotate. In the present embodiment, the pump shaft 9 may drive the second rotor 22 to rotate, and is connected to the second rotor 22. The second rotor is arranged adjacent to the first end of the pump shaft 9. The pump shaft 9 is connected to the second rotor assembly 3, and the second rotor assembly 3 is arranged adjacent to the second end of the pump shaft 9. The second rotor assembly 3 drives the second rotor 22 to rotate via the pump shaft 9, so as to rotate the first rotor assembly 2, that is, the second rotor 22 and the first rotor 21 realize transmission through meshing between the internal teeth of the first rotor 21 and external teeth of the second rotor 22.

Referring to FIG. 1, the first cavity 80 may have the working medium flowing through, and the first cavity 80 is communicated to the second cavity 90. Part of the working medium in the first cavity 80 may enter the second cavity 90 and contact with at least part of the stator assembly 4 located in the second cavity 90, so that the working medium in the second cavity may exchange or transfer heat with the stator assembly, thereby facilitating heat dissipation of the stator assembly 4. In an embodiment, the electric oil pump 100 includes a first flow channel 20 and a second flow channel 30. Part of the working medium in the first cavity 80 may enter the second cavity 90 through the first flow channel 20 and contact the stator assembly 4 located in the second cavity 90, and then the working medium in the second cavity 90 may flow out through the second flow channel 30, so that the working medium located in the second cavity 90 has fluidity and the flowing working medium is more conducive to heat dissipation of the stator assembly. Referring to FIG. 1, the electric oil pump 100 further includes the isolating member 5. The stator assembly 4 is disposed on a first side of the isolating member 5, and the electric control board assembly 6 is disposed on a second side of the isolating member 5. The isolating member 5 is fixedly connected to the wiring terminal 10, and a connecting position between the wiring terminal 10 and the isolating member 5 is sealed. A sealing structure is provided between the isolating member 5 and the pump housing, so that a connecting position between the isolating member 5 and the pump housing is sealed. Therefore, the second cavity 90 is unable to communicate with one side of the isolating member 5 where the electric control board assembly 6 is located via the connecting position between the wiring terminal 10 and the isolating member 5, and via the connecting position between the isolating member 5 and the pump housing. Such arrangements are beneficial to prevent the working medium from entering the one side of the isolating member 5 where the electric control board assembly 6 is located, thereby helping to prevent the working medium from adversely affecting performance of the electric control board assembly 6, and thereby avoiding affecting performance of the electric oil pump.

Figure 16:
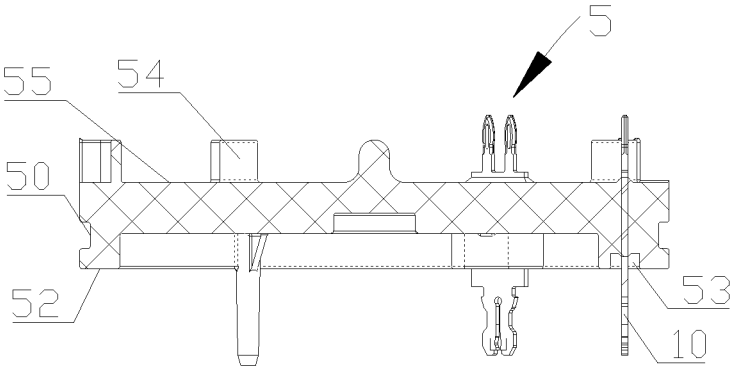
FIG. 16 is a cross-sectional view taken along C-C in FIG. 15.

Referring to FIG. 16, the isolating member 5 is provided with a slot 50 disposed on an outer peripheral side wall of the isolating member 5. Combined with FIG. 1, the electric oil pump 100 includes a seal ring 70 disposed in the slot 50 of the isolating member 5, and the isolating member 5 and the seal ring 70 may prevent the working medium from entering the one side of the isolating member 5 where the electric control board assembly 6 is located along the outer peripheral side wall of the isolating member 5.

Referring to FIGS. 13 to 16, the isolating member 5 includes a groove 53 recessed from an upper surface 52 of the isolating member 5. The groove 53 does not penetrate through the isolating member 5 and the wiring terminal 10 passes through the groove 53. A gap is provided between an outer periphery of the wiring terminal 10 disposed in the groove 53 and an inner wall of the groove 53, and the gap is filled with a sealant (not shown in the figure). Combined with FIG. 1, in the present embodiment, when the electric oil pump 100 is in operation, the working medium flows into the second cavity 90, such arrangement is conducive to heat dissipation of the stator assembly 4. In order to prevent the working medium from seeping into the one side of the isolating member 5 where the electric control board assembly 6 is located from the connecting position between the wiring terminal 10 and the isolating member 5, the groove 53 is filled with the sealant, which is beneficial to prevent the working medium from seeping into the one side of the isolating member 5 where the electric control board assembly 6 is located from the connecting position between the wiring terminal 10 and the isolating member 5. In the present embodiment, the isolating member 5 and the wiring terminal 10 are integrally formed by injection molding to achieve fixed connection of the isolating member 5 and the wiring terminal 10, and then the groove 53 is filled with the sealant to get sealed.

Figure 13:
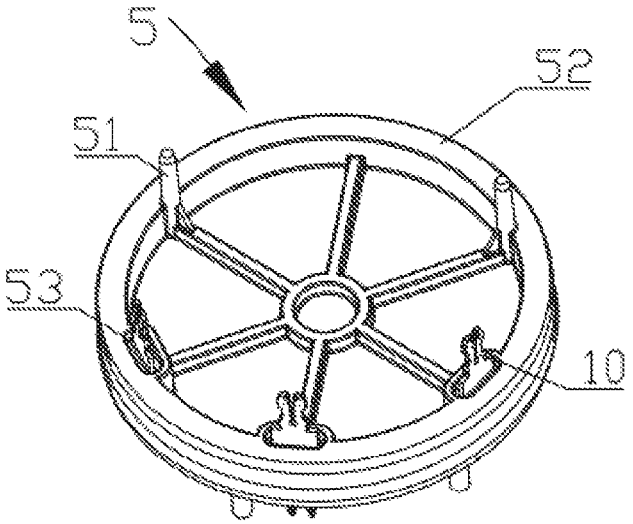
FIG. 13 is a perspective structural schematic view illustrating an isolating member combining with a wiring terminal in FIG. 1 along one direction.

Therefore, defects such as blowholes generated in an injection molding process of the components are prevented, thereby preventing the working medium from seeping into the one side of the isolating member 5 where the electric control board assembly 6 is located in FIG. 1 through the blowholes. In an embodiment, on the premise that the injection molding does not cause defects such as blowholes, the wiring terminal 10 may also be directly fixed with the isolating member 5 by injection molding to achieve sealing between the wiring terminal 10 and the isolating member 5. At this moment, it is not necessary to provide the groove 53 and fill the groove 53 with the sealant to get sealed. Referring to FIGS. 1 and 13, in the present embodiment, the isolating member 5 is located in a cavity of the second housing 7, and at least part of the outer peripheral side wall of the isolating member 5 is tightly fitted with an inner peripheral side wall of the second housing 7, thereby achieving fixation of the isolating member 5.

Referring to FIG. 1, the electric oil pump 100 includes the fluid inlet 11 and the fluid outlet 12. The fluid inlet 11 is configured for the working medium to flow in, and the fluid outlet 12 is configured for the working medium to flow out. In the present embodiment, the fluid inlet 11 includes a first fluid inlet 111, a second fluid inlet 112, and a third fluid inlet 113. The first fluid inlet 111 and the second fluid inlet 112 are in communication with each other, and the first fluid inlet 111 and the third fluid inlet 113 are in communication with each other. The fluid outlet 12 includes a first fluid outlet 121 and a second fluid outlet 122 that are in communication with each other. The fluid inlet 11 and the fluid outlet 12 of the electric oil pump in the present embodiment are described in detail below.

Figure 3:
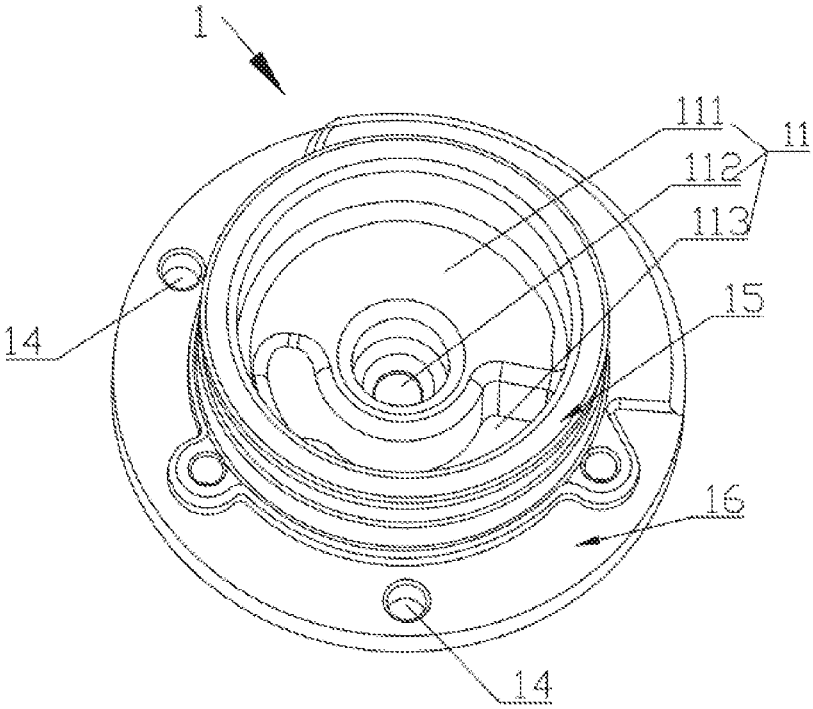
FIG. 3 is a perspective structural schematic view illustrating a first housing in FIG. 1 in one direction.
Figure 4:
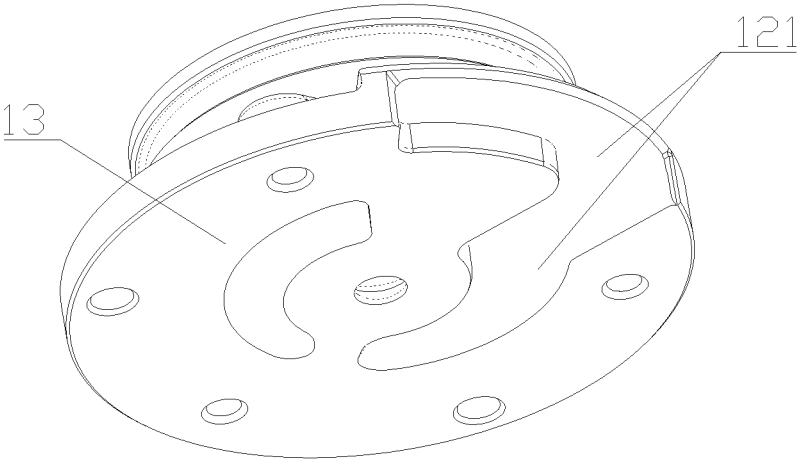
FIG. 4 is a perspective structural schematic view illustrating a first housing in FIG. 1 in another direction.
Figure 5:
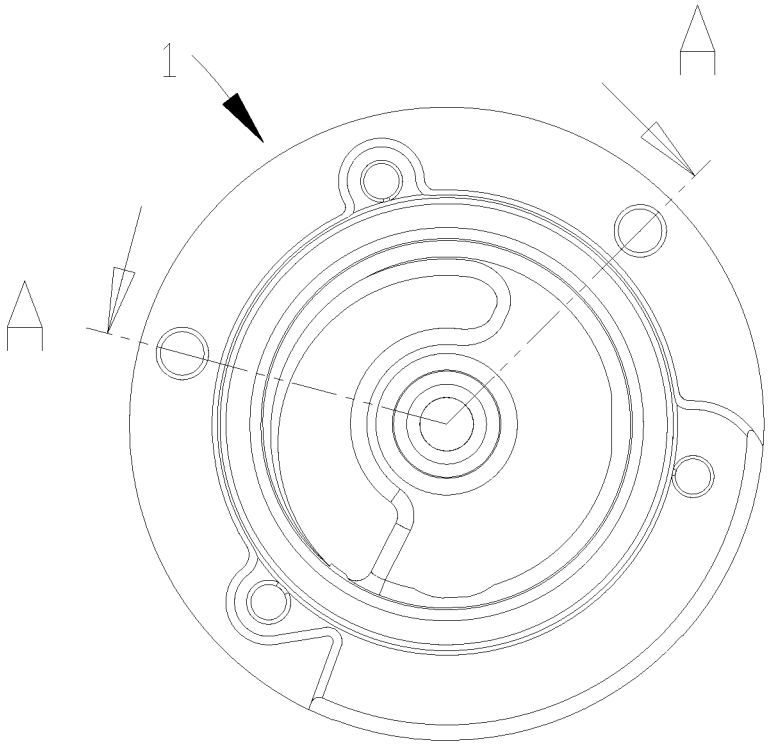
FIG. 5 is a front view illustrating the first housing in FIG. 3 or FIG. 4.
Figure 6:
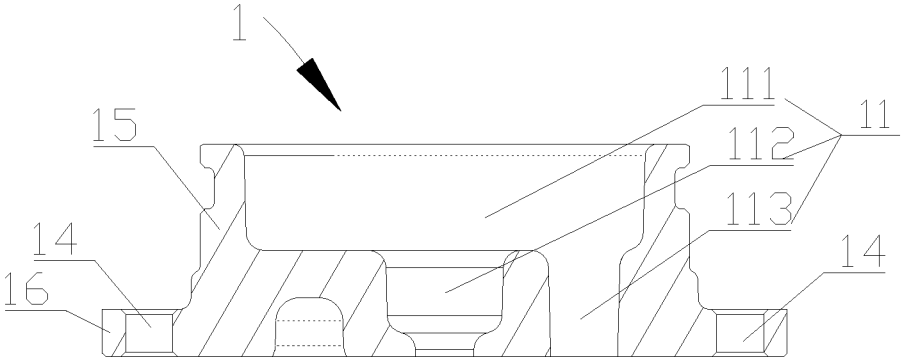
FIG. 6 is a cross-sectional view taken along A-A in FIG. 5.
Figure 7:
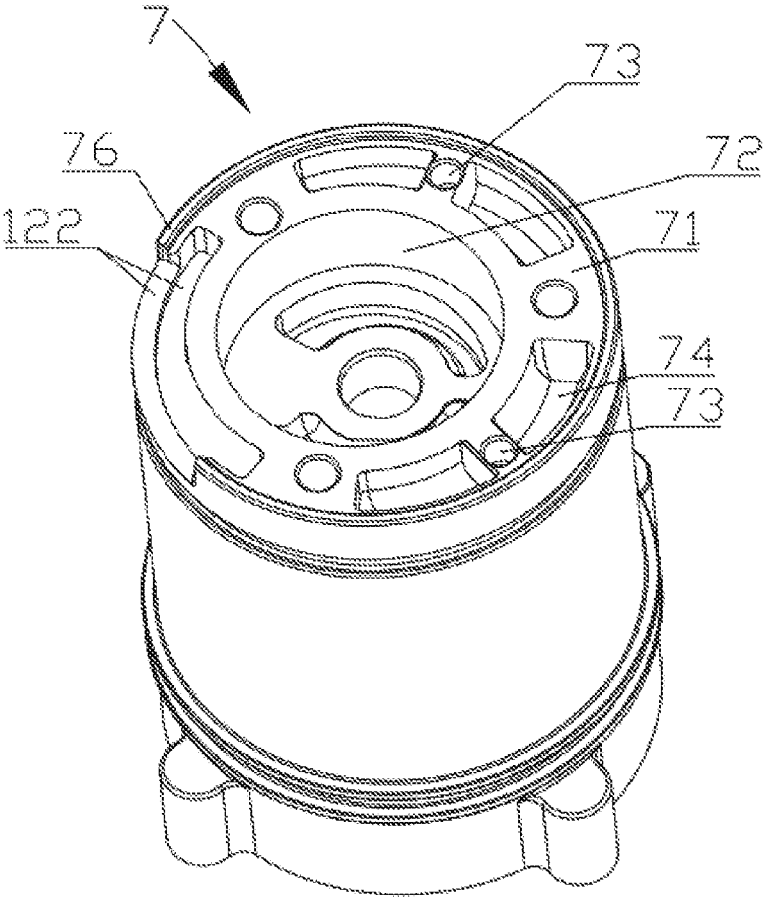
FIG. 7 is a perspective structural schematic view illustrating a second housing in FIG. 1.
Figure 8:
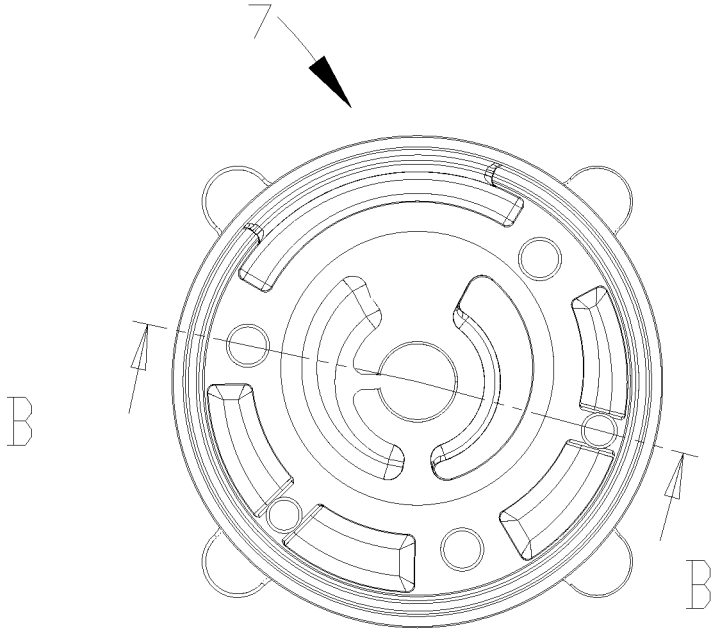
FIG. 8 is a front view illustrating the second housing in FIG. 7.

Referring to FIGS. 3 to 6, the third housing 1 includes the fluid inlet 11, and the fluid inlet 11 includes the first fluid inlet 111, the second fluid inlet 112, and the third fluid inlet 113. The first fluid inlet 111 and the second fluid inlet 112 are in communication with each other, and the first fluid inlet 111 and the third fluid inlet 113 are in communication with each other. The working medium flows into the electric oil pump through the first fluid inlet 111, part of the working medium that flows into the electric oil pump enters the first flow channel 20 in FIG. 1 through the second fluid inlet 112, and another part of the working medium enters the hydraulic cavity 801 in FIG. 2 through the third fluid inlet 113. Such arrangements are conducive to distribution of the working medium. In an embodiment, the part of the working medium enters the first flow channel 20 in FIG. 1 through the second fluid inlet 112, and then enters the second cavity 90 in FIG. 1 and contacts with the stator assembly located in the second cavity 90. The other part of the working medium enters the hydraulic cavity 801 in FIG. 2 through the third fluid inlet 113, so that the other part of the working medium that enters the hydraulic cavity 801 generates the flowing power through volume change of the hydraulic cavity. Referring to FIG. 4, the third housing 1 includes an end surface 13. Combined with FIG. 1, the end surface 13 is disposed in contact with the second housing 7. The third housing 1 includes a first fluid outlet 121 recessed from the end surface 13 of the third housing 1 toward a direction away from the end surface 13 of the third housing 1. In condition that the first fluid outlet 121 is orthographically projected to the end surface of the third housing 1, at least part of an outer edge of the first fluid outlet 121 coincides with an outer edge of the end surface 13 of the third housing 1, and such arrangement facilitates outflow of the working medium. Referring to FIG. 7, the second housing 7 is provided with the second fluid outlet 122 recessed from an upper surface 71 of the second housing 7 toward a direction away from the upper surface 71 of the second housing 7. In condition that the second fluid outlet 122 is orthographically projected to the upper surface 71 of the second housing 7, at least part of an outer edge of the second fluid outlet 122 coincides with an edge of an outer peripheral side wall of the second housing 7, and such arrangement facilitates the outflow of the working medium. Referring to FIG. 1, when the third housing 1 and the second housing 7 are assembled together, a position of the first fluid outlet 121 and a position of the second fluid outlet 122 are oppositely disposed, so that the first fluid outlet 121 is in communication with the second fluid outlet 122, thereby facilitating the outflow of the working medium. In the present embodiment, the fluid outlet 12 includes the first fluid outlet 121 and the second fluid outlet 122, and the first fluid outlet 121 and the second fluid outlet 122 are disposed on two different housings, respectively, such arrangement is beneficial to simplify a mold. In an embodiment, only one fluid outlet may be provided, in which case the fluid outlet may be disposed on the first housing 8.

The third housing 1 includes at least two first positioning holes 14. Referring to FIGS. 3 to 6, in the present embodiment, the third housing 1 includes two first positioning holes 14, where the first positioning holes 14 each are a through hole, and the two first positioning holes 14 are asymmetrically disposed along a central axis of the first housing 8. The third housing 1 includes a first portion 15 and a second portion 16 that are integrally formed, where an outer peripheral diameter of the first portion 15 is less than that of the second portion 16, and the first positioning holes 14 each are formed in the second portion 16.

Referring to FIGS. 7 to 10, the second housing 7 includes an accommodating portion 72 formed with an accommodating cavity. Referring to FIG. 1, the first rotor assembly 2 is disposed in the accommodating cavity. The second housing 7 includes at least two second positioning holes 73. The at least two second positioning holes 73 each are a blind hole, the at least two second positioning holes 73 are asymmetrically distributed along a central axis of the second housing 7, and positions of the second positioning holes 73 and positions of the first positioning holes 14 in FIG. 3 are correspondingly disposed. Referring to FIG. 1, during assembling the third housing 1 with the second housing 7, positioning posts on an external tooling are used, the first positioning holes 14 on the third housing 1 are fitted precisely with the positioning posts on the external tooling, the second positioning holes 73 on the second housing 7 are precisely fitted with the positioning post on the external tooling, so that during assembling the third housing 1 with the second housing 7, the first positioning holes 14 and the second positioning holes 73 are used as positioning reference, and such arrangement is beneficial to improve assembly precision of the third housing 1 and the second housing 7. In an embodiment, a positioning post may be formed on the third housing 1 and a positioning hole may be formed on the second housing 7 corresponding to the positioning post. Assembly precision of the second housing 7 and the third housing 1 is improved by clearance fit between the positioning post and the positioning hole. In another embodiment, a positioning hole may be formed on the third housing 1, and a positioning post may be formed on the second housing 7 corresponding to the positioning hole.

Referring to FIGS. 7 to 10, along an axial direction of the second housing 7, the second positioning hole 73 extends from the upper surface 71 of the second housing 7 toward the direction away from the upper surface 71 of the second housing 7. Referring to FIG. 1, the upper surface 71 of the second housing 7 is disposed in contact with the end surface 13 of the third housing 1 in FIG. 4. The second housing 7 includes recess portions 74 that are recessed from the upper surface 71 of the second housing 7 toward the direction away from the upper surface 71 of the second housing 7, and the recess portions 74 are distributed at intervals along a circumferential direction of the second housing 7. In the present embodiment, the second housing 7 includes four recess portions 74. The four recess protrusions 74 are provided to facilitate reducing weight of the second housing 7, and to further enable a wall thickness of the second housing 7 as uniform as possible, thereby facilitating processing and shaping of the second housing. The second housing 7 includes a flange portion 76 that is arranged to protrude out from the upper surface 71 of the second housing 7 toward the direction away from the upper surface 71 of the second housing 7. Referring to FIG. 1, at least part of an outer peripheral side wall of the third housing 1 is in clearance fit with an inner peripheral side wall of the flange portion 76, so that during assembling the third housing 1 with the second housing 7, the third housing 1 is limited in a radial direction of the third housing 1, thereby facilitating assembly of the third housing 1 and the second housing 7.

Figure 9:
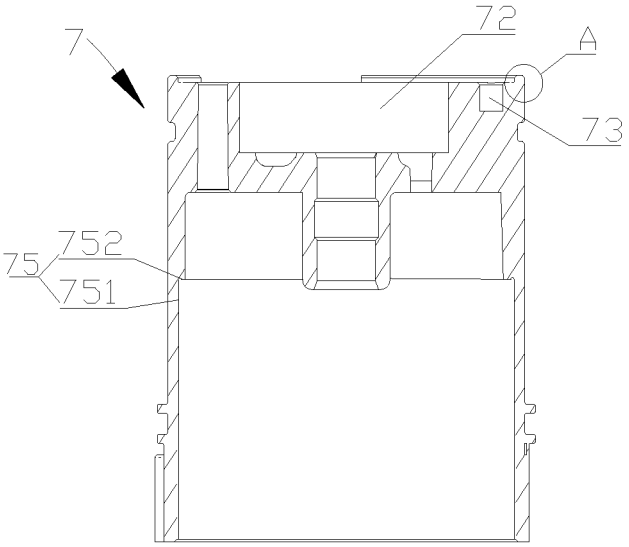
FIG. 9 is a cross-sectional view illustrating the second housing taken along B-B in FIG. 8.
Figure 10:
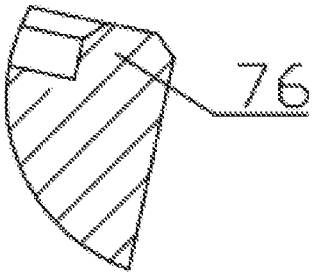
FIG. 10 is a partial enlarged schematic view illustrating a position A in FIG. 9.
Figure 11:
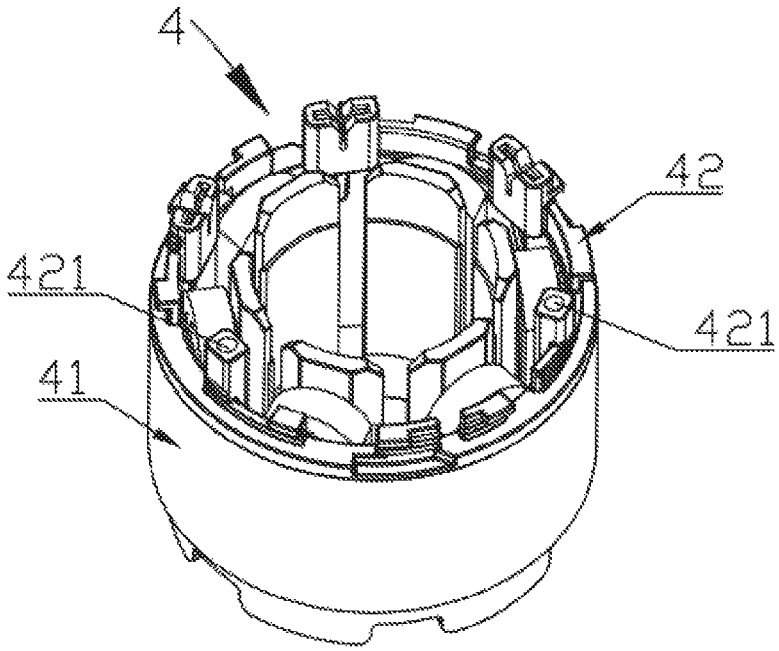
FIG. 11 is a perspective structural schematic view illustrating a stator assembly in FIG. 1 in one direction.
Figure 12:
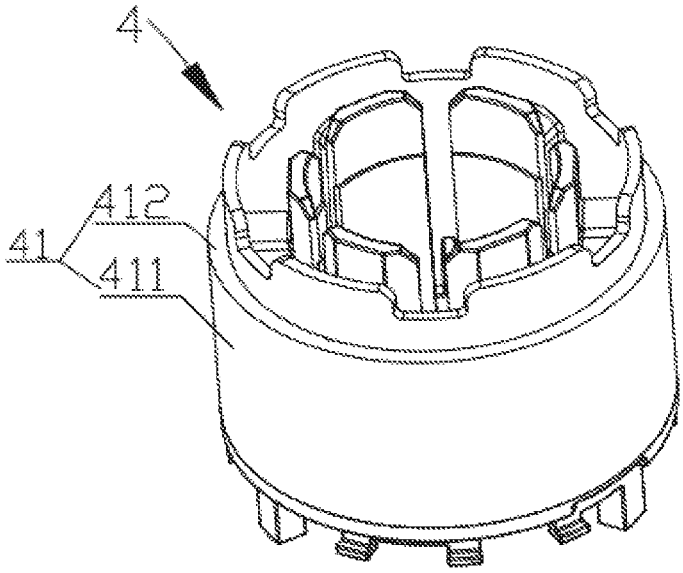
FIG. 12 is a perspective structural schematic view illustrating the stator assembly in FIG. 1 in another direction.

Referring to FIG. 9, the second housing 7 includes a stepped portion 75. The stepped portion 75 includes a first limit surface 751 and a second limit surface 752 that are disposed perpendicular to each other, here, verticality within a processing error range is within the protection scope of the present application. Referring to FIGS. 11 and 12, the stator assembly 4 includes a stator iron core 41. Referring to FIG. 1, an outer peripheral side wall 411 of the stator iron core 41 is tightly fitted with the first limit surface 751 of the second housing 7 in FIG. 9, and an end surface 412 of the stator iron core 41 is disposed in contact with the second limit surface 752 of the second housing 7 in FIG. 9, so that during assembling the stator assembly 4 and the second housing 7, the stator assembly 4 is limited in the axial direction and the circumferential direction of the stator assembly 4. Referring to FIG. 11, the stator assembly 4 includes an insulating frame 42 fixedly connected to the stator iron core 41. In the present embodiment, the stator iron core 41 is used as an inserting member, the insulating frame 42 and the stator iron core 41 are integrally formed by injection molding, and the insulating frame 42 includes a third positioning hole 421. Referring to FIG. 13, the isolating member 5 includes a first positioning portion 51. Referring to FIG. 1, the first positioning portion 51 is inserted into the third positioning hole 421 of the stator assembly 4 in FIG. 11 and is correspondingly fitted with the third positioning hole 421. Such arrangements facilitate positioning of the isolating member 5 and the stator assembly 4 during the assembly of the isolating member 5 with the stator assembly 4, and avoiding misassembly of the isolating member 5. In the present embodiment, the isolating member 5 includes two first positioning portions 51. A number of the third positioning holes 421 is equal to a number of the first positioning portions 51, and the first positioning portions 51 each have a cylindrical shape. In an embodiment, each of the first positioning portions 51 may also be square, D-shaped, circular-ring shaped, or other special-shaped structures.

Referring to FIG. 1, the electric oil pump 100 includes the wiring terminal 10, and at least part of the wiring terminal 10 passes through the isolating member 5 and is fixedly connected to the isolating member 5. A first end of the wiring terminal 10 is connected to the stator assembly 4 in FIG. 1, and a second end of the wiring terminal 10 is connected to the electric control board assembly 6. The assembly of the wiring terminal 10 with the stator assembly 4 and the assembly of the wiring terminal 10 with the electric control board assembly 6 are described in detail below.

Figure 17:
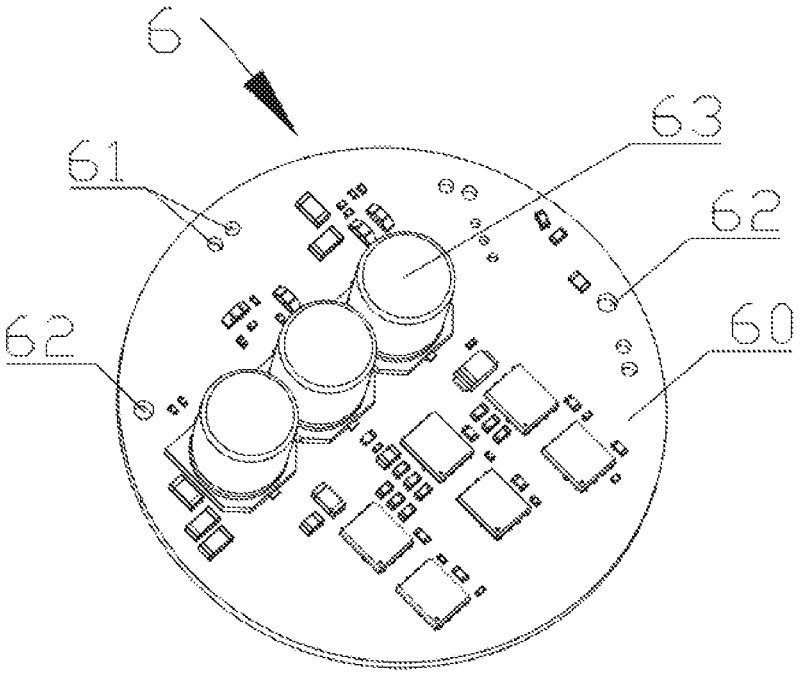
FIG. 17 is a perspective structural schematic view illustrating an electric control board assembly in FIG. 1.

Referring to FIGS. 13 to 16, the wiring terminal 10 and the isolating member 5 are fixedly connected. In the present embodiment, the wiring terminal 10 is used as the inserting member, and the wiring terminal 10 is integrally formed with the isolating member 5 by injection molding to form one first assembly. Referring to FIG. 1, during assembling the first assembly, the first positioning portion 51 is inserted into the third positioning hole 421 of the stator assembly 4 in FIG. 11 and is correspondingly fitted with the third positioning hole 421, and at least part of the outer peripheral side wall of the isolating member 5 is tightly fitted with the inner peripheral side wall of the second housing 7. In the present embodiment, the first assembly is assembled by press fitting, so that the first end of the wiring terminal 10 is connected to the stator assembly 4 in FIG. 1. In the present embodiment, the upper surface 52 of the isolating member 5 is in contact with the stator assembly 4 in FIG. 1 to realize the axial limit of the isolating member 5. Referring to FIG. 17, the electric control board assembly 6 includes a connecting hole 61, and the connecting hole 61 is correspondingly fitted with the wiring terminal 10 in FIG. 16. In FIG. 16, the second end of the wiring terminal 10 is inserted into and tightly fitted with the connecting hole 61, so as to realize connection between the wiring terminal 10 and the electric control board assembly 6.

Figure 14:
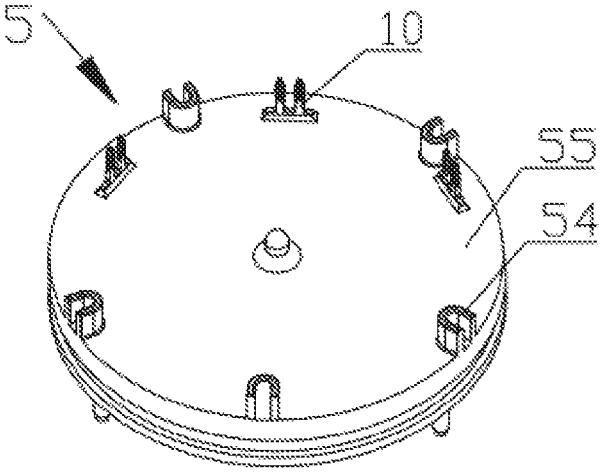
FIG. 14 is a perspective structural schematic view illustrating the isolating member combining with the wiring terminal in FIG. 1 along another direction.
Figure 15:
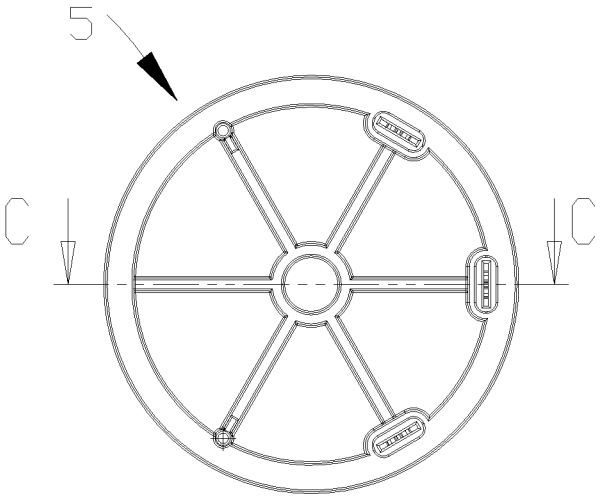
FIG. 15 is a front view illustrating the isolating member combining with the wiring terminal in FIG. 13 or FIG. 14.

Referring to FIG. 14, the isolating member 5 includes at least two first protrusion portions 54 that are arranged to protrude out from a lower surface 55 of the isolating member 5 toward a direction away from the lower surface 55, and the at least two first protrusion portions 54 are distributed at intervals along a circumferential direction of the isolating member 5. In the present embodiment, the isolating member 5 includes five first protrusion portions 54. With reference to FIG. 1, on the one hand, the first protrusion portions 54 can provide support to the electric control board assembly 6 in FIG. 1, and on the other hand, during assembling the electric control board assembly 6, the arrangement of the first protrusion portions 54 can limit the electric control board assembly 6 in the axial direction of the electric control board assembly 6, thereby facilitating the assembly of the electric control board assembly 6.

Figure 18:
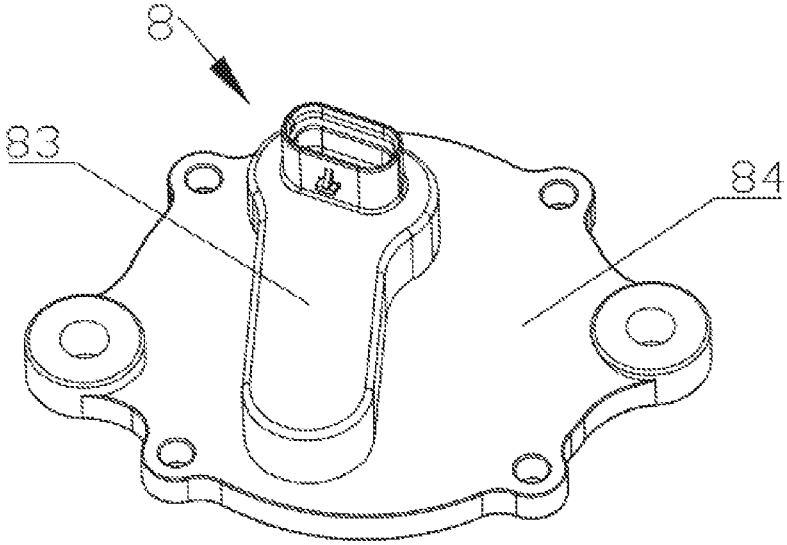
FIG. 18 is a perspective structural schematic view illustrating a third housing in FIG. 1 in one direction.
Figure 19:
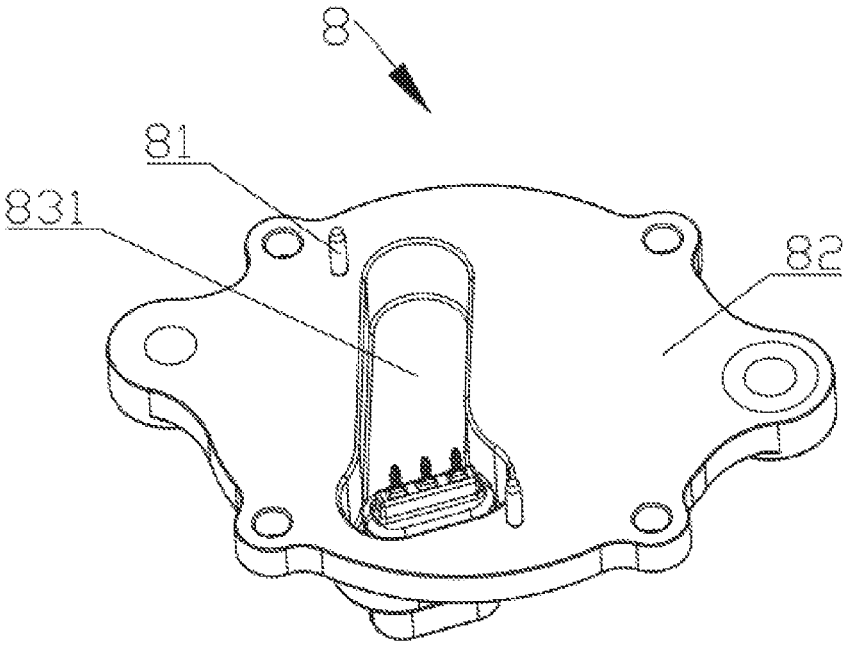
FIG. 19 is a perspective structural schematic view illustrating the third housing in FIG. 1 in another direction.

Referring to FIG. 1, the electric oil pump 100 includes the first housing 8 that capable of covering the electric control board assembly 6. Referring to FIGS. 18 and 19, the first housing 8 includes a second positioning portion 81 that is arranged to protrude out from a lower surface 82 of the first housing 8. Referring to FIG. 1, the lower surface 82 of the first housing 8 is disposed in contact with a lower surface of the second housing 7. Referring to FIG. 17, the electric control board assembly 6 includes a base plate 60 that is configured as a carrier for mounting electrical components and laying wires. The base plate 60 includes a fourth positioning hole 62, and the second positioning portion 81 is inserted into the fourth positioning hole 62 and is correspondingly arranged in clearance fit with the fourth positioning hole 62, so that during assembling the first housing 8, the second positioning portion 81 of the first housing 8 is in clearance fit with the fourth positioning hole 62 of the electric control board assembly 6, thereby facilitating improvement of assembly precision of the first housing 8. In the present embodiment, a number of the fourth positioning holes 62 is equal to a number of the second positioning portions 81. In an embodiment, two second positioning portions 81 are provided, and the second positioning portion 81*s* each have a cylindrical shape. The second positioning portion 81 and the fourth positioning hole 62 are arranged in a shape-fit manner, and the "arranged in a shape-fit manner" here means that an outer contour of the second positioning portion 81 is substantially the same as a contour of the fourth positioning hole 62. In other embodiments, the second positioning portion 81 may also be square, D-shaped, circular-ring shaped, or other special-shaped structures.

Referring to FIG. 18, the first housing 8 includes a second protrusion portion 83 that is arranged to protrude out from an upper surface 84 of the first housing 8 toward a direction away from the upper surface 84 of the first housing 8, and the second protrusion portion 83 is provided with a hollow cavity 831. Referring to FIG. 17, the electric control board assembly 6 includes a capacitor 63. With reference to FIG. 1, the capacitor 63 is disposed in the hollow cavity 831. In the present embodiment, the second protrusion portion 83 is arranged to provide an accommodating space for the capacitor 63 on the electric control board assembly 6, thereby preventing the capacitor 63 from interfering the assembly of the first housing 8.

Figure 20:
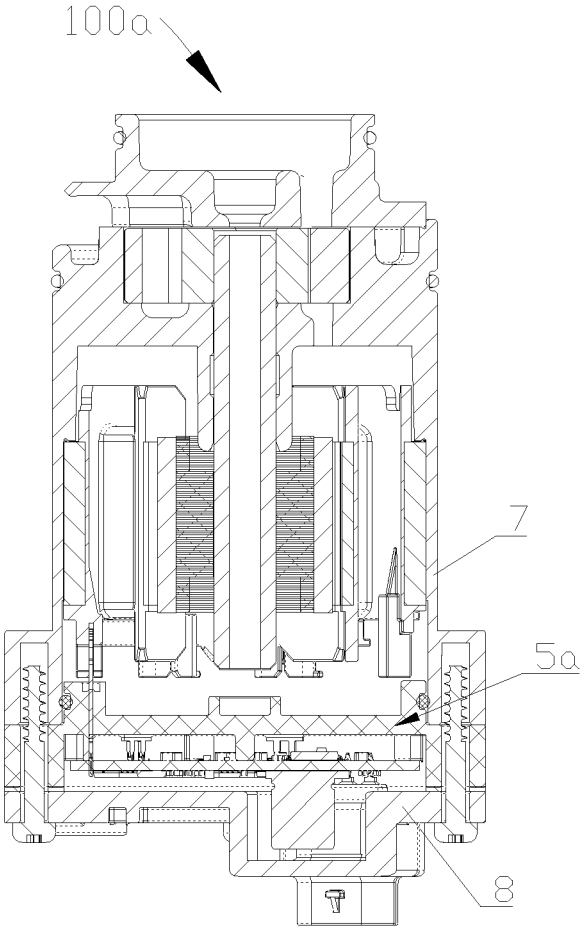
FIG. 20 is a cross-sectional view illustrating an electric oil pump in the second implementation manner according to an embodiment.
Figure 21:
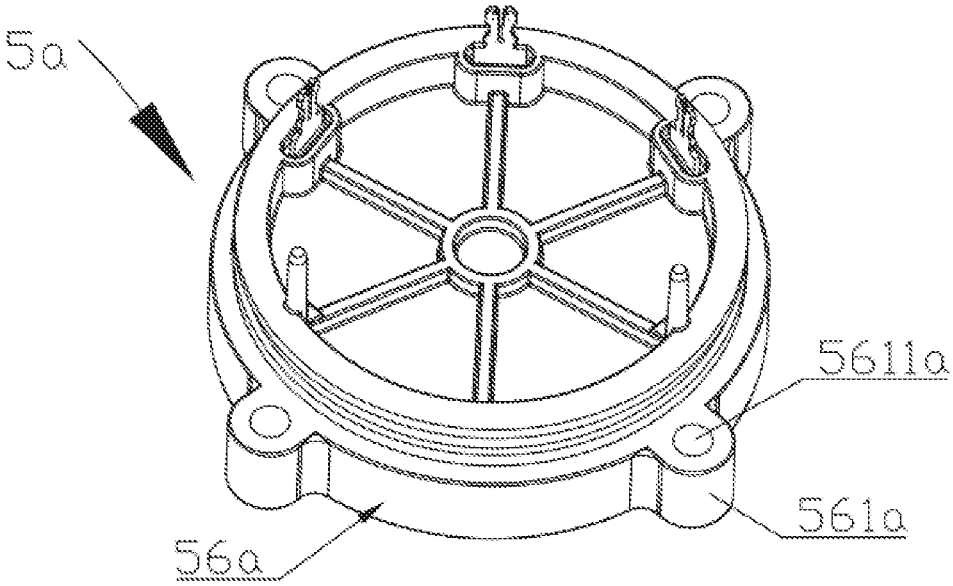
FIG. 21 is a perspective structural schematic view illustrating an isolating member combining with a wiring terminal in FIG. 20 in one direction.
Figure 22:
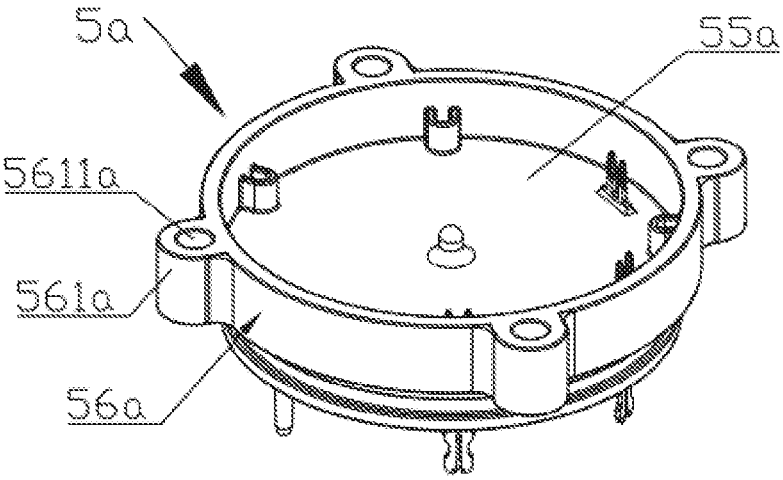
FIG. 22 is a perspective structural schematic view illustrating isolating member and the wiring terminal in FIG. 20 in another direction.
Figure 23:
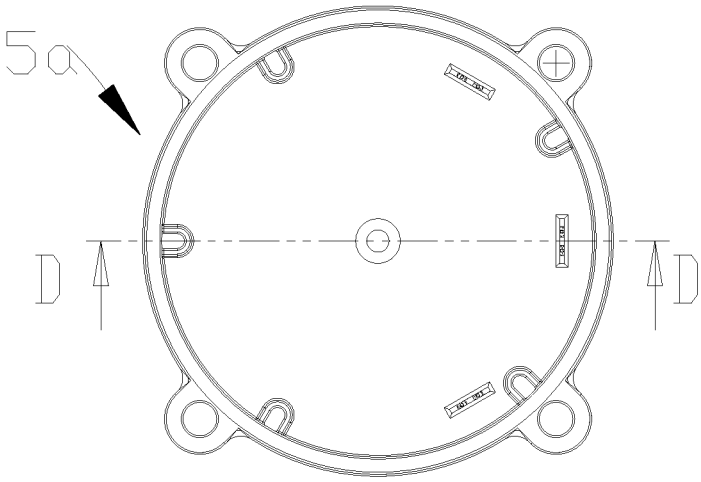
FIG. 23 is a front view illustrating the isolating member combining with the wiring terminal in FIG. 21 or FIG. 22.

FIG. 20 is a structural schematic view illustrating an electric oil pump in the second implementation manner. Referring to FIG. 20, the electric oil pump 100*a* further includes an isolating member 5*a*, where the isolating member 5*a* is at least partially disposed between the stator assembly 4 and the electric control board assembly 6, and is detachably connected to the second housing 7 and the first housing 8, respectively. In an embodiment, the isolating member 5*a* may be connected to the second housing 7 and the first housing 8 by a screw or a bolt, respectively. Referring to FIGS. 21 and 22, the isolating member 5*a* includes a boss portion 56*a* that is arranged to protrude out from a lower surface 55*a* toward a direction away from the lower surface 55*a*. The boss portion 56*a* includes a connecting portion 561*a* formed with a connecting hole 5611*a*, and the connecting hole 5611*a* is a through hole. Referring to FIG. 20, the boss portion 56*a* is detachably connected to the second housing 7 and the first housing 8 by a screw or a bolt, respectively, and the screw or bolt sequentially passes through the connecting hole 5611*a* of the boss portion 56*a* and the connecting hole of the second housing 7 from the connecting hole of the first housing 8.

Figure 24:
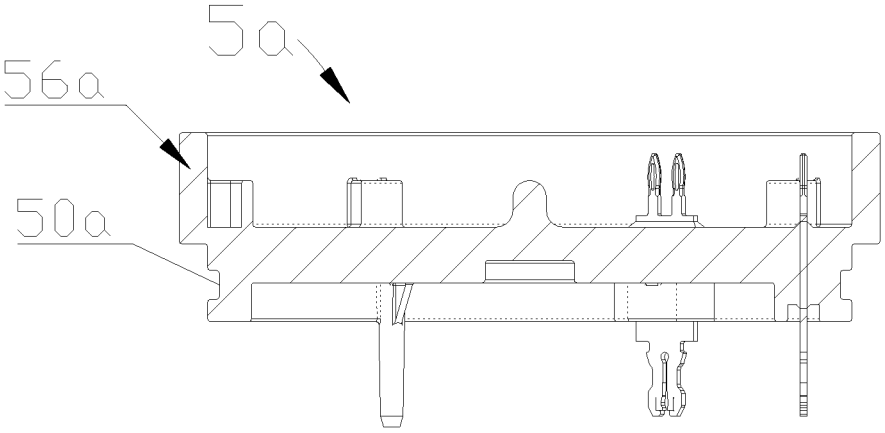
FIG. 24 is a cross-sectional view illustrating the isolating member combining with the wiring terminal in FIG. 23 taken along D-D.

Referring to FIG. 24, the isolating member 5*a* includes a slot 50*a* disposed on an outer peripheral side wall of the isolating member 5*a*. Combined with FIG. 20, the electric oil pump 100*a* includes a seal ring 70 disposed in the slot 50*a* of the isolating member 5*a*, and the isolating member 5*a* and the seal ring 70 can prevent the working medium from leaking along the outer peripheral side wall of the isolating member 5*a* through a connecting position between the isolating member 5*a* and the second housing 7, thereby helping to prevent the working medium from leaking to an outside of the electric oil pump and affecting the performance of the electric oil pump.

Compared with the electric oil pump in the first implementation manner, the isolating member 5*a* in the second implementation manner includes the boss portion 56*a*, and the isolating member 5*a* is detachably connected to the first housing 8 and the second housing 7 via the boss portion 56*a*, respectively. Compared with the electric oil pump and the isolating member in the first implementation manner, the isolating member 5*a* of the electric oil pump in the second implementation manner is detachably connected to the first housing 8 and the second housing 7 by a screw or a bolt. Such connecting manner is simpler and more conducive to assembly. For other features of the electric oil pump and the isolating member 5*a* of the electric oil pump in the second implementation manner, reference may be made to the electric oil pump and the isolating member in the first implementation manner, and details are not described herein again.

What is claimed is:

1. An electric oil pump, comprising:

a pump housing provided with an inner pump cavity, wherein the inner pump cavity comprises a first cavity and a second cavity that are in communication with each other;

a first rotor assembly disposed in the first cavity;

a stator assembly and a second rotor assembly that are disposed in the second cavity;

a pump shaft, wherein the first rotor assembly is disposed adjacent to a first end of the pump shaft, part of the first rotor assembly is connected to the pump shaft, and the second rotor assembly is disposed adjacent to a second end of the pump shaft and is connected to the pump shaft;

an electric control board assembly;

an isolating member, wherein the stator assembly is disposed at a first side of the isolating member, the electric control board assembly is disposed at a second side of the isolating member, and the isolating member is connected to the pump housing; and a wiring terminal fixedly connected to the isolating member;

wherein a connecting position between the wiring terminal and the isolating member is sealed and a connecting position between the isolating member and the pump housing is sealed, so that the second cavity is unable to communicate with one side of the isolating member where the electric control board assembly is located via the connecting position between the wiring terminal and the isolating member, and via the connecting position between the isolating member and the pump housing; and wherein the isolating member is provided with a groove recessed from an upper surface of the isolating member, the wiring terminal is configured to pass through the groove, a sealant is filled between an outer periphery of the wiring terminal and an inner wall of the groove, so that the connecting position between the wiring terminal and the isolating member is sealed.

2. The electric oil pump according to claim 1, wherein the isolating member is further provided with a slot disposed at an outer peripheral side wall of the isolating member, the electric oil pump further comprises a seal ring, wherein the seal ring is disposed in the slot, and the connecting position between the isolating member and the pump housing is sealed by the seal ring.

3. The electric oil pump according to claim 1, wherein the pump housing comprises a first housing and a second housing, wherein the first housing is configured to cover the electric control board assembly and detachably connected to the second housing, the isolating member is disposed in a cavity of the second housing, and at least part of an outer peripheral side wall of the isolating member is tightly fitted with an inner peripheral side wall of the second housing.

4. The electric oil pump according to claim 1, wherein the pump housing comprises a first housing and a second housing, wherein the first housing is configured to cover the electric control board assembly, at least part of the isolating member is disposed between the first housing and the second housing, and the isolating member is detachably connected to the first housing and the second housing by a screw or a bolt, respectively.

5. The electric oil pump according to claim 3, wherein the pump housing further comprises a third housing, wherein the third housing comprises a fluid inlet, and the fluid inlet is configured for a working medium to flow in; the third housing comprises at least two first positioning holes, wherein the at least two first positioning holes each are a through hole, and the at least two first positioning holes are disposed asymmetrically along a central axis of the third housing; the second housing is detachably connected to the third housing, and the second housing comprises at least two second positioning holes, wherein the at least two second positioning holes each are a blind hole, the at least two second positioning holes are disposed asymmetrically along a central axis of the second housing, and positions of the at least two second positioning holes correspond to positions of the at least two first positioning holes.

6. The electric oil pump according to claim 4, wherein the pump housing further comprises a third housing, wherein the third housing comprises a fluid inlet, and the fluid inlet is configured for a working medium to flow in; the third housing comprises at least two first positioning holes, wherein the at least two first positioning holes each are a through hole, and the at least two first positioning holes are disposed asymmetrically along a central axis of the third housing; the second housing is detachably connected to the third housing, and the second housing comprises at least two second positioning holes, wherein the at least two second positioning holes each are a blind hole, the at least two second positioning holes are disposed asymmetrically along a central axis of the second housing, and positions of the at least two second positioning holes correspond to positions of the at least two first positioning holes.

7. The electric oil pump according to claim 5, wherein the third housing comprises a first portion and a second portion that are integrally formed, wherein an outer periphery diameter of the first portion is less than that of the second portion, and the at least two first positioning holes are further configured to be formed in the second portion.

8. The electric oil pump according to claim 7, wherein the at least two second positioning holes each are configured to extend along an axial direction of the second housing from an upper surface of the second housing toward a direction away from the upper surface of the second housing, and the upper surface of the second housing is in contact with an end surface of the third housing; the second housing comprises a flange portion, the flange portion is configured to protrude from the upper surface of the second housing toward the direction away from the upper surface of the second housing, and at least part of an outer peripheral side wall of the third housing is in clearance fit with an inner peripheral side wall of the flange portion.

9. The electric oil pump according to claim 8, wherein the second housing comprises a stepped portion, the stepped portion comprises a first limit surface and a second limit surface, wherein the first limit surface is vertically disposed relative to the second limit surface, the stator assembly comprises a stator iron core, an outer peripheral side wall of the stator iron core is tightly fitted with the first limit surface, and an end surface of the stator iron core is in contact with the second limit surface.

10. The electric oil pump according to claim 9, wherein the stator assembly further comprises an insulating frame fixedly connected to the stator iron core, wherein the insulating frame comprises a third positioning hole, and the isolating member comprises a first positioning portion configured to be inserted into the third positioning hole.

11. The electric oil pump according to claim 10, wherein the wiring terminal is configured to at least partially pass through and fixedly connected to the isolating member, the electric control board assembly comprises a base plate, a first end of the wiring terminal is connected to the stator assembly, and a second end of the wiring terminal is connected to the base plate.

12. The electric oil pump according to claim 11, wherein the first housing comprises a second positioning portion, the second positioning portion is configured to protrude out from a lower surface of the first housing toward a direction away from the lower surface of the first housing, the electric control board assembly comprises a fourth positioning hole disposed on the base plate, and the second positioning portion is configured to be inserted into the fourth positioning hole and in clearance fit with the fourth positioning hole.

13. The electric oil pump according to claim 2, wherein the pump housing comprises a first housing and a second housing, wherein the first housing is configured to cover the electric control board assembly and detachably connected to the second housing, the isolating member is disposed in a cavity of the second housing, and at least part of an outer peripheral side wall of the isolating member is tightly fitted with an inner peripheral side wall of the second housing.

14. The electric oil pump according to claim 1, wherein the pump housing comprises a first housing and a second housing, wherein the first housing is configured to cover the electric control board assembly and detachably connected to the second housing, the isolating member is disposed in a cavity of the second housing, and at least part of an outer peripheral side wall of the isolating member is tightly fitted with an inner peripheral side wall of the second housing.

15. The electric oil pump according to claim 2, wherein the pump housing comprises a first housing and a second housing, wherein the first housing is configured to cover the electric control board assembly, at least part of the isolating member is disposed between the first housing and the second housing, and the isolating member is detachably connected to the first housing and the second housing by a screw or a bolt, respectively.

16. The electric oil pump according to claim 1, wherein the pump housing comprises a first housing and a second housing, wherein the first housing is configured to cover the electric control board assembly, at least part of the isolating member is disposed between the first housing and the second housing, and the isolating member is detachably connected to the first housing and the second housing by a screw or a bolt, respectively.

17. The electric oil pump according to claim 6, wherein the third housing comprises a first portion and a second portion that are integrally formed, wherein an outer periphery diameter of the first portion is less than that of the second portion, and the at least two first positioning holes are further configured to be formed in the second portion.

* * * * *